US007991216B2

(12) United States Patent
Lin et al.

(10) Patent No.: US 7,991,216 B2
(45) Date of Patent: Aug. 2, 2011

(54) METHOD OF ANALYZING EFFECTIVE POLISHING FREQUENCY AND NUMBER OF POLISHING TIMES ON POLISHING PADS HAVING DIFFERENT PATTERNS AND PROFILES

(75) Inventors: Zone-ching Lin, Taipei (TW); Chein-chung Chen, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 798 days.

(21) Appl. No.: 12/056,050

(22) Filed: Mar. 26, 2008

(65) Prior Publication Data

US 2008/0312876 A1 Dec. 18, 2008

(30) Foreign Application Priority Data

Jun. 15, 2007 (TW) ..... 96121754 A

(51) Int. Cl.
*G06K 9/00* (2006.01)

(52) U.S. Cl. ..... 382/141

(58) Field of Classification Search ..... 382/141, 382/152

See application file for complete search history.

(56) References Cited

U.S. PATENT DOCUMENTS

| | | | | |
|---|---|---|---|---|
| 6,517,668 | B2 * | 2/2003 | Agarwal | 156/345.12 |
| 6,562,182 | B2 * | 5/2003 | Agarwal | 156/345.1 |
| 6,776,871 | B2 * | 8/2004 | Agarwal | 156/345.13 |
| 7,299,107 | B2 * | 11/2007 | Lin et al. | 700/121 |
| 2002/0028646 | A1 | 3/2002 | Jensen et al. | |
| 2007/0050077 | A1 | 3/2007 | Tran et al. | |

FOREIGN PATENT DOCUMENTS

| | | | |
|---|---|---|---|
| TW | 462906 | B | 11/2001 |
| TW | 505555 | B | 10/2002 |
| TW | I221435 | B | 10/2004 |
| TW | 200608012 | A | 3/2006 |
| TW | I254371 | B | 5/2006 |
| TW | 200626289 | A | 8/2006 |
| TW | 200633814 | A | 10/2006 |

* cited by examiner

*Primary Examiner* — Roy Punnoose

(74) *Attorney, Agent, or Firm* — Kirton & McConkie; Evan R. Witt

(57) ABSTRACT

A method for analyzing the effectiveness of polishing frequency and the number of polishing times on the polishing pads having different patterns and profiles while performing the chemical-mechanical polishing process on the wafers is described. This method is to convert the images of various patterns and topography of the chips and grinding pads into binary images, and then calculates the binary images by numerical matrix method, which only needs to calculate the modified model of the position changed and the frequency of grinding during the rotation and deformation of different patterns and topography during relative movement, and then uses overlay model of effective grinding frequency to predict the distribution of effective grinding frequency at a fixed period of grinding time under a set grinding path. Further proposes the overlay model of the grinding frequency of "Least Pixel Number (LPN)", "Cross-section Check CSC", "Straight Line-Path Effective polishing Factor (SLEF)" and "Scale Factor (SF)," so as to develop the procedures of analyzing the distribution condition of effective grinding frequency on the surface of the chips. It is referential to design better patterns and topography of grinding pads as well as setting the assembly parameters for CMP machines in the future.

19 Claims, 15 Drawing Sheets

METHOD OF ANALYZING EFFECTIVE POLISHING FREQUENCY AND NUMBER OF POLISHING TIMES ON POLISHING PADS HAVING DIFFERENT PATTERNS AND PROFILES

FIELD OF THE INVENTION

The present invention relates to a method of analyzing the polishing frequency and the number of polishing times, and more particularly relates to a method for analyzing the effectiveness of polishing frequency and the number of polishing times on the polishing pads having different patterns and profiles while performing the chemical-mechanical polishing (hereinafter named CMP) process on the wafers.

BACKGROUND OF THE INVENTION

The method of chemical-mechanical polishing (CMP) process is one of global planarization techniques which utilizes the mechanical manner by grinding material and the chemical manner by acid-base balance solution to partially remove surface portion of the wafer for globally planarizing the surface of the wafer so that the subsequent thin film deposition and etching processes can be implemented. Since the global planarization technique is a basic step of an inter-connection metallization process of the wafer and the CMP process is generally accepted feasible for globally planarizing the surface of the wafer, thus, the CMP process is widely used in the semiconductor process.

Conventionally, while performing the CMP process of the global planarization technique, the pressure distribution of the wafer is generated by the finite element method to evaluate the probable statuses of pressure field associated with the wafer. The distribution of relative velocity field on the wafer is made by a relative velocity formula which indicates the relative rotation speed between the wafer and arbitrary positions of the polishing pad. In another case, the relationship between the velocity field and the removal rate is created by experimental results associated with the wafer.

During the CMP process, the functions of the polishing pads includes: (1) uniformly spreading the slurry on the polished surface of the wafer; (2) removing the polished material away from the surface of the wafer; and (3) mechanically providing the wafer with the carrying platform. In fact, although it is quite complicated among mechanical, chemical, and physical effects while performing the CMP process, however, the material-removal rate (MRR) commonly dominates the result of the CMP process and MRR is described by Preston's formula: $MRR=C_p \times P \times V$, where "$C_p$" is Preston coefficient, "P" is down force or pressure, and "V" is the relative velocity of wafer to pad.

While polishing the wafer by a generic CMP process, the rotation direction and rotation speed of the wafer covered by the polishing pad are the same as these of the polishing pad and theoretically, the relative velocity of each position on the wafer is the same. In another case of compensation CMP process, the velocity field distribution of the wafer is not uniform because endpoint detection and polished amount saving of the pad need to be considered. No matter how the generic CMP process or the compensation CMP process is used to satisfy the functions (1) and (2) of the polishing pads in the above-mentioned description, a plurality of patterns and grooves must be formed on the polishing pad in the prior art.

However, while performing the generic CMP process having patterns and the compensation CMP process having different patterns and profiles, the practical polishing frequency and the number of polishing times on the polishing pads have errors in comparison to theoretical results of the pads. Further, these problems are still not solved. Consequently, there is a need to develop a novel method to solve the above-mentioned problems.

SUMMARY OF THE INVENTION

One objective of the present invention is to provide a method of analyzing the polishing frequency and the number of polishing times for examining the effectiveness of polishing frequency and the number of polishing times on the polishing pads having different patterns and profiles.

Another objective of the present invention is to provide a method of analyzing the polishing frequency and the number of polishing times for examining the effectiveness of polishing frequency and the number of polishing times while the polishing pads of the chemical-mechanical polishing process perform on the wafers at a planetary movement path.

Still another objective of the present invention is to provide a method of analyzing the polishing frequency and the number of polishing times for early predicting the uneven area on the wafer due to polishing frequency change in order to reduce endpoint detection of the wafer.

According to the above objectives, the present invention is to provide a method of analyzing the polishing frequency and the number of polishing times. In one embodiment, the method includes the steps of:

(1) establishing the analytical model for generating the numerical matrices of the wafer and polishing pad;

(2) setting the polishing parameters, such as the polishing time, the abrasive particle diameter, and interval increment of the polishing time;

(3) calculating the effective number of polishing times while one position on the polishing pad polishes the wafer along the predetermined movement path during the interval increment of the polishing time;

(4) calculating the numerical matrix associated with the effective number of polishing times while one position on the polishing pad polishes the wafer during the interval increment of the polishing time; and (5) calculating the effective number of the polishing times and the polishing frequency of the wafer after superposing the matrix of the effective number of times on the wafer during a span of time.

FIG. 1*a* is a schematic view of a compensation CMP system according to one embodiment of the present invention. The wafer is positioned under the polishing pad. The polishing pad and the compensation polishing head are located on the wafer. The slurry and air are injected into the compensation CMP system via the top of the compensation polishing head and the air exhausts from the bottom of the compensation polishing head.

The present invention rapidly transforms the design image into binary numerical matrices (K(i, j)) wherein the design image is preferably generated by computer aid design (CAD) software has different patterns and profiles. Further, the method converts the design image having different patterns and profiles into binary numerical values for rapidly and effectively establishing the analytical model. The method is suitable for the polishing pad having different patterns and profiles, such as square lattice shape, concentric circle shape, and spiral shape. In another embodiment, the enveloped profiles having complicated curves, such as cubic curve and/or spline curve, are also suitable for the present invention. Therefore, the steps of the method for analyzing the polishing frequency and the number of polishing times are not limited to specific patterns and profiles.

Although, the relative velocity between the wafer and the polishing pad, and the different patterns and profiles on the polishing pad dominate the distribution status of the polishing frequency on the wafer, however the present invention assumes that the areas of which the polishing pad passes are defined as the effective polishing areas in view of general scale. Further, the abrasive particles are uniformly distributed on the polishing pad. The first size ($D_A$), defined as the size before the abrasive particle contacts the wafer, is substantially equal to the second size, defined as the size after the abrasive particle contacts the wafer.

The contact times per time unit between a position on the wafer and the abrasive particle on the polishing pad is defined as the effective polishing frequency F, described by the following formula. During a time interval, the number of polishing times is defined as the grinding times when the abrasive particle contact the wafer and the abrasive particle thus polishes the wafer. That is, the number of polishing times represents that the total amount of abrasive particles pass the same position on the wafer during the time interval.

$$F = \frac{U}{D_A} = \frac{\sqrt{R_P^2(w_P - w_W)^2\cos\theta_P^2 + D_{wp}^2 w_P^2}}{D_A}$$

where "U" is the relative velocity between the wafer and the polishing pad;

"$D_A$" is the initial size, i.e. the first size, of the abrasive particle;

"$P(R_p, \theta_p)$" is the point coordinate on the wafer;

"$(\omega_w, \omega_p)$" are the rotation speed of the wafer and the polishing pad, respectively; and "$D_{wp}$" is the central distance between the wafer and the polishing pad.

The present invention provides four types of correction methods for modifying the errors generated by the rotation of the different patterns and profiles and the cumulative error of the number of polishing times. The types of correction method includes: (1) the least pixel number (LPN); (2) the scale factor (SF); (3) the cross-section check (CSC); and (4) the straight line-path effective polishing factor (SLEF). These correction methods are described in detail as follows.

FIG. 5*a* is a schematic view of the polishing pad having an oval-shaped profile composed of a plurality of square lattices according to one embodiment of the present invention. FIG. 5*b* is a schematic monochrome view of the polishing pad of the transformation of the oval-shaped profile composed of the lattices shown in FIG. 5*a* according to one embodiment of the present invention. FIG. 5*c* is a partially enlarged view of the polishing pad shown in FIG. 5*b* according to one embodiment of the present invention. FIG. 5*d* is a schematic view of the polishing pad having an oval-shaped profile with rotation angle 60° according to one embodiment of the present invention. FIG. 5*e* is a schematic monochrome view of the polishing pad of the transformation of the oval-shaped profile with rotation angle 60° according to one embodiment of the present invention. FIG. 5*f* is a partially enlarged view of the polishing pad with rotation angle 60° shown in FIG. 5*e* according to one embodiment of the present invention. Each of the square lattices in FIG. 5*f* serves a small polishing pad which rotates about the rotation center of the polishing pad. The square lattices of the polishing pad shown in FIG. 5*c* are transformed into the rhombus shapes having sawtooth on the polishing pad shown in FIG. 5*f*. Each of square lattices or rhombus shapes has a plurality of pixels, that is, each pixel serves as the polishing area, which is different from the design image. Further, the area between the patterns does not serve the polishing function. Therefore, the present invention provides four kinds of correction methods as follows.

(1) The least pixel number (LPN). The present invention is capable of adjusting the matrix size of the acquired pixels. Theoretically, the partition size of the acquired pixels can be divided into an abrasive particle. However, if each of the divided matrix size is too small, an enlarged binary numerical matrix is generated, thereby consuming a lot of analytical time. Conversely, if each of the divided matrix size is too big, the patterns positioned on small divisions are regarded as the area of pad (i, j)=0 due to round-off during the transformation of the matrix. Based on the consumption of analytical time and pixel transformation analytical capability, the present invention provides the formula of least pixel number (LPN) for optimizing the size of the binary transformation matrix. An example of patterns having spiral shapes shown in FIG. 4*a* illustrates the transformation process. During the transformation process of the binary matrix, the area enveloped by a spiral pattern is transformed into the points in form of values "0" and the points in form of values "1" except the values "0" on the spiral pattern, as shown in FIG. 4*b*.

(2) The scale factor (SF). In the present invention, the image generated by the CAD software, such as AUTOCAD application program, is transformed into the binary numerical matrix and the proportion of the length and the width of the image is kept constant after the transformation. Since each matrix size of the acquired pixels is different, each pixel unit represents the area having relative ratio. The method of the present invention calculates the effectiveness of polishing frequency by the relative velocity of the binary numerical matrix. The matrix value calculated by the binary numerical matrix has a ratio to the factual length size of the image. Thus, the ratio is defined as the scale factor (SF). After the rotation time is increased by the interval increment Δt, the number of polishing times is multiplied by the scale factor (SF). Briefly, the scale factor (SF) is used to convert the length size of the pixel into the factual length size.

(3) The cross-section check (CSC). Based on the precision, when the binary numerical matrix generated by the patterns of the polishing pad simulates the rotation of the polishing pad, the matrix value is located in the integer of the binary numerical matrix associate with the wafer. In addition, there are some deformation errors at the edge of the patterns due to round-off. The present invention employs the cross-section check (CSC) method to correct the deformation errors. Regarding the deformation of the binary numerical matrix due to rotation, FIG. 5*a* and FIG. 5*d* show the case. FIG. 5*a* is a schematic view of the polishing pad having an oval-shaped profile composed of a plurality of square lattices. The lattices have square shape in FIG. 5*a*. FIG. 5*d* is a schematic view of the polishing pad having an oval-shaped profile with rotation angle 60°. The edges of the lattices of the patterns have the deformation in form of sawtooth. The deformation errors are increasingly cumulative while the simulation time of the polishing pad increases. In view of pixel matrix, each pixel has four adjacent pixels and generates a cross shape wherein the cross shape maintain relative position constant after or before rotation. The method checks and corrects the value of binary numerical matrix on the four adjacent points after the pattern rotation. The detailed descriptions are as follows.

(4) The straight line-path effective polishing factor (SLEF). Regarding the polishing pad exceeding the size of the wafer, some invalid polishing area on the polishing pad, which is deemed as effective polishing area, is located along the polishing movement path when the polishing pad polishes the wafer from the external portion to the internal portion of the wafer during the interval increment of the polishing time. Further, some errors of invalid polishing area are cumulated in the polishing frequency and the number of polishing times. The method corrects the errors of invalid polishing area by the straight line-path effective polishing factor (SLEF). FIG. 7*a* the point pad (i, j) on the polishing pad. During the polishing time increment, the polishing pad polishes the wafer from the external portion to the internal portion of the wafer and moves from pad (i, j) to npad (i', j'), and thus a portion of movement path of the polishing pad polishes the wafer. Since the length of movement path is small and approximately regarded as linear path, as shown in FIG. 7*b*. The effective polishing ratio of the linear path is the ratio of which the Linear path passes the values "0" and "1" for correcting the effective number of the times during the polishing time increment.

The four correction methods are as follows.

(1) The least pixel number (LPN): when the CAD image is transformed into the binary numerical matrix, the acquired size of the least pixel number (LPN) is determined by the following rule: (a) The image having the length and width sizes of "L×L" is divided into the pixel matrix "N×N" (pixels). That is, the image is divided into "N" portions. The length of each pixel is represented as: R=L/N (mm); (b) In view of a pattern area, if coordinate ($X_d$, $Y_d$) is one point which is located in the area "A" enveloped by the pattern area, the pixel coordinate of the pixel is represented as Fix ($X_d$×R, $Y_d$×R), wherein "Fix" represents the integers generated by round-off. When the pixel coordinate is converted into image numerical matrix, the value of the pixel coordinate is defined as "0" and the rest of pixels except the pixel coordinate are defined as "255", such as the patterns having sawtooth shape as shown in FIG. 7*c*. The above transformation methods are described as follows:

<1> calculates the least pattern area "A": The 2-D drawing tool generates the polishing pad having a plurality of patterns and profiles, and forming a plurality of closed areas within the patterns and profiles for acquiring one of closed areas to be served as the least pattern area. The 2-D drawing tool then calculates the least pattern area "A".

<2> calculate the least pixel number (LPN): The least pattern area "A" need to be satisfied with the following formula: $A \geqq (L/N)^2$, to avoid the least pattern area as "0" due to the round-off of the image numerical matrix. Further, if the pixel matrix is "N×N" (pixels), the least pixel number (LPN) need to be satisfied with the following formula: $LPN \geqq L\sqrt{A}$.

(2) The scale factor (SF): In the present invention, the image generated by the CAD software, such as AUTOCAD application program, is transformed into the binary numerical matrix and the proportion of the length and the width of the image is kept constant after the transformation. Since each matrix size of the acquired pixels is different, each pixel unit represents the area having relative ratio. The method of the present invention calculates the effectiveness of polishing frequency by the relative velocity of the binary numerical matrix. The matrix value calculated by the binary numerical matrix has a ratio to the factual length size of the image. Thus, the ratio is defined as the scale factor (SF). After the rotation time is increased by the time increment Δt, the number of polishing times is multiplied by the scale factor (SF). Briefly, the scale factor (SF) is used to convert the length size of the pixel into the factual length size. The scale factor (SF) can be represented by the following formula:

SF=(diameter($d_w$) of the wafer profile of the design image)/(pixel number on the wafer based on the diameter($d_w$) after converting wafer profile into image)

(3) The straight line-path effective polishing factor (SLEF): Since the patterns and profile of the polishing pad is not limited for the internal portion of the wafer, the size of the profile is greater than the size of the pattern to make the edge polishing of the wafer effective. After rotating the unit angle Δθ, a portion of rotation path in the polishing velocity field is located on the wafer for polishing and another portion of the rotation path is located out of the wafer. Thus, the time increment Δt is decreased to reduce the unit angle Δθ. Since the distance from the rotation position to the rotation center is various, a portion of polishing areas may be contained in a plurality of numerical matrix of the wafer.

To increase the analytical precision and meet the requirement of the numerical matrix, straight line-path effective polishing factor (SLEF) is provided for correcting the method. As shown in FIG. 7*a* and FIG. 7*b*, the detailed descriptions are as follows:

<1> In the movement path of the absolute coordinate, the wafer is deemed as a fixed object and the method thus computes the matrix position of the wafer numerical matrix when the polishing pad passes from pad (i, j) to npad (i', j') along the slope path. The method further checks the matrix position of the wafer numerical matrix to determine the value of the position matrix is "1". If the value is "1", the matrix position is an effective position on which the polishing pad polishes. Conversely, if the value is "0", the matrix position is an ineffective position on which the polishing pad polishes. Because the unit angle Δθ is small, the rotation path of the polishing pad from pad (i, j) to npad (i', j') is a straight line-path approximately. Assume that $\vec{x}=i'-i$, $\vec{y}=j'-j$, the linear length (l) from pad (i, j) to npad (i', j') is $l=\sqrt{\vec{x}^2+\vec{y}^2}$ <2> When the position of the numerical matrix moves from pad (i, j) to npad (i', j'), the movement increment point of the polishing pad is represented as the following formula:

$$\text{pad}\left(i+\text{fix}\left(nstep*\frac{\bar{x}}{\sqrt{\bar{x}^2+\bar{y}^2}}\right),\ j+\text{fix}\left(nstep*\frac{\bar{y}}{\sqrt{\bar{x}^2+\bar{y}^2}}\right)\right),$$

The coordinates of the pad (i, j) has to be located in the integer of the binary numerical matrix. The "fix" symbol represents that the method takes the integer by round-off after increasing the unit length increment. The "nstep" symbol represents length interval and is range from 1 to l wherein the unit interval is one.

<3> Since a portion of the rotation polishing path located out of the wafer is ineffective polishing and another portion of rotation polishing path located on the wafer is effective polishing, it is required to compute the movement increment points of the polishing pad and calculates the total amount of the value "1" in the polished wafer numerical matrix along the straight line-path. The straight line-path effective polishing factor (SLEF) can be represented by the following formula:

SLEF=(total amount of the position value "1" on the polished wafer numerical matrix along the straight line-path)/(total amount of the positions on the polished wafer numerical matrix along the straight line-path)

(4) The cross-section check (CSC): After computing the numerical matrix of the polishing pad, pad (i, j) moves to npad (i', j') during the time increment Δt. Since the computation result of npad (i', j') may not be integer, the method generates an integer coordinate corresponding to one position of the wafer numerical matrix by round-off rule and thus makes errors. If the polishing pad has a solid profile, the error in npad (i', j') can be corrected by npad (i'+1, j') and npad (i'−1, j') and the error is one pixel. If the polishing pad has different patterns and profiles, the cross-section check method is employed to improve the method for reducing the error in the solid profile. The present invention provides the cross-section check (CSC) method for correcting the errors in the polishing pad having different patterns and profiles. The cross-section check (CSC) method is described as follows:

<1> As shown in FIG. 6*a*, before the polishing pad rotates, the four points around the pad (i, j) are pad (i+1, j), pad (i−1, j), pad (i, j+1), and pad (i, j−1). Because it is required that the values of the four points are the same before and after the rotation of the polishing pad, the correction position is defined as the cross position surrounded by the four points.

<2> After pad (i, j) on the polishing pad makes revolution and rotation, pad (i, j) moves to npad (i', j'). The rotation angle of the profile of the polishing pad is represented by the formula: $\theta=(\theta_p+\Delta\theta_p)+(\theta_w+\Delta\theta_w)$. After the polishing pad rotates, the center npad (cx', cy') of the polishing pad can be moved to pad (cx, cy) to calculate the included angle θ.

<3> In view of binary numerical matrix, there are eight matrix coordinates along eight adjacent directions. After the polishing pad rotates, the values of the four points are the same as previous values. However, because the included angle θ associated with the four points are different, the values of the four points are distributed in different directions, respectively, as show sections I to VIII in FIG. 6*c*. Based on the above-mentioned rule, the cross-section check (CSC) method corrects the four points around the rotation position to the relative positions, respectively. The position correction on the polishing pad having different patterns and profile are described as follows:

If the rotation interval is represented by the formula: $0°<\theta<45°$, i.e. section I, the effective number of polishing times at the four points surrounding npad (i', j') is FF(i', j'), and the values of the effective numbers of polishing times at the four points are recorded on the relative positions of the wafer. That is, wafer (i+1, j)=FF(i+1', j'), wafer (i, j+1)=FF(i', j+1'), wafer (i−1, j)=FF(i−1', j'), and wafer (i, j−1)=FF(i', j−1').

If the rotation interval is represented by the formula: $45°<\theta\leqq 90°$, i.e. section II, then, $$\text{wafer}(i+1,j)=FF(i+1',i+j'),\ \text{wafer}(i,j+1)=FF(i-1',j'),\ \text{wafer}(i-1,j)=FF(i-1',j-1'),\ \text{and wafer}(i,j-1)=FF(i+1',j-1').$$

Similarly, the method can correct the binary numerical matrix after the polishing pad having different patterns and profile rotates at a different angle.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

The present invention provides a method of analyzing the effectiveness of polishing frequency and the number of polishing times on the polishing pads having different patterns and profiles while performing the chemical-mechanical polishing (hereinafter named CMP) process on the wafers. Further, the present invention digitizes the analytical model by employing image processing modes based on different patterns and profiles of the polishing pads. The numerical matrix associated with the polishing pad is re-evaluated for analyzing the distribution state of the effectiveness of polishing frequency and the number of polishing times.

The term of "effective polishing region" is defined as contact area between the polishing pad and wafer, where the abrasive particles are uniformly positioned on the polishing pad. The first size, defined as the size before the abrasive particle contacts the wafer, is substantially equal to the second size, defined as the size after the abrasive particle contacts the wafer. The contact times per time unit between a position on the wafer and the abrasive particle on the polishing pad is defined as the effectiveness of polishing frequency, described by the formula: F=U/d, where "F" is the effectiveness of polishing frequency, "U" is the relative velocity between the wafer and the polishing pad, and "d" is the first (or initial) size of the abrasive particle.

During a time interval, the number of polishing times is defined as the grinding times when the abrasive particle contact the wafer and the abrasive particle then polishes the wafer. That is, the number of polishing times represents the total amount of abrasive particles passing through the same position on the wafer during the time interval.

Figure 1A:
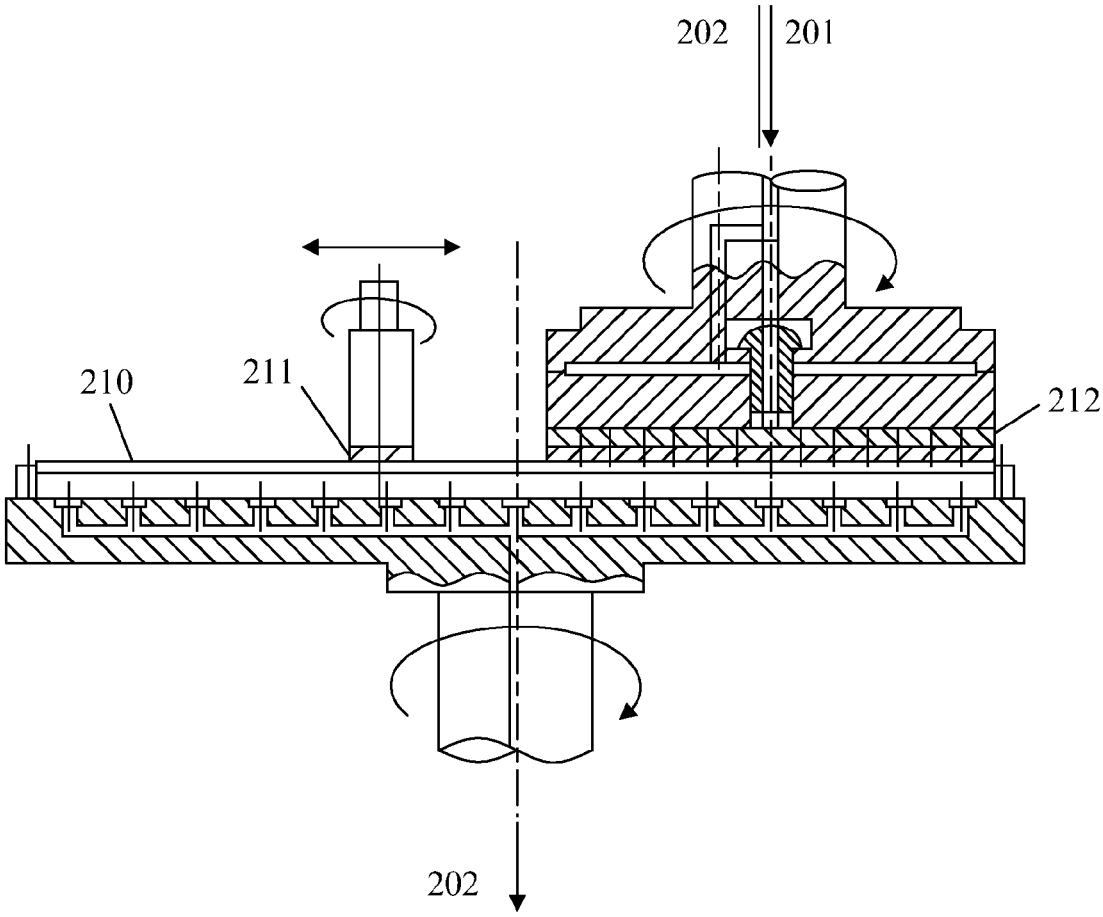
FIG. 1*a* is a schematic view of a compensation CMP system according to one embodiment of the present invention.
Figure 1B:
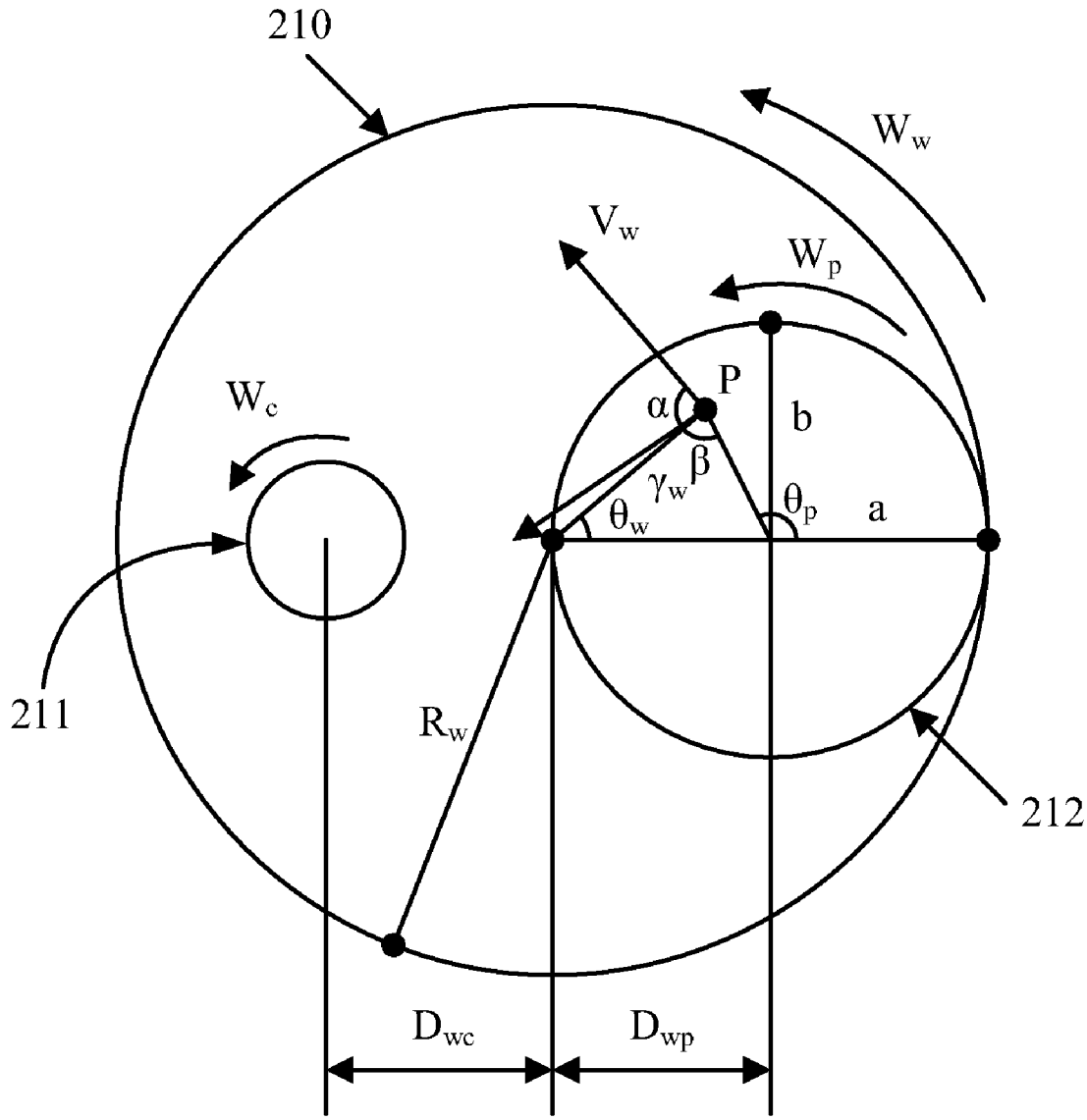
FIG. 1*b* is a schematic analytical view of relative movement path between the wafer and the polishing pad according to one embodiment of the present invention.
Figure 1C:
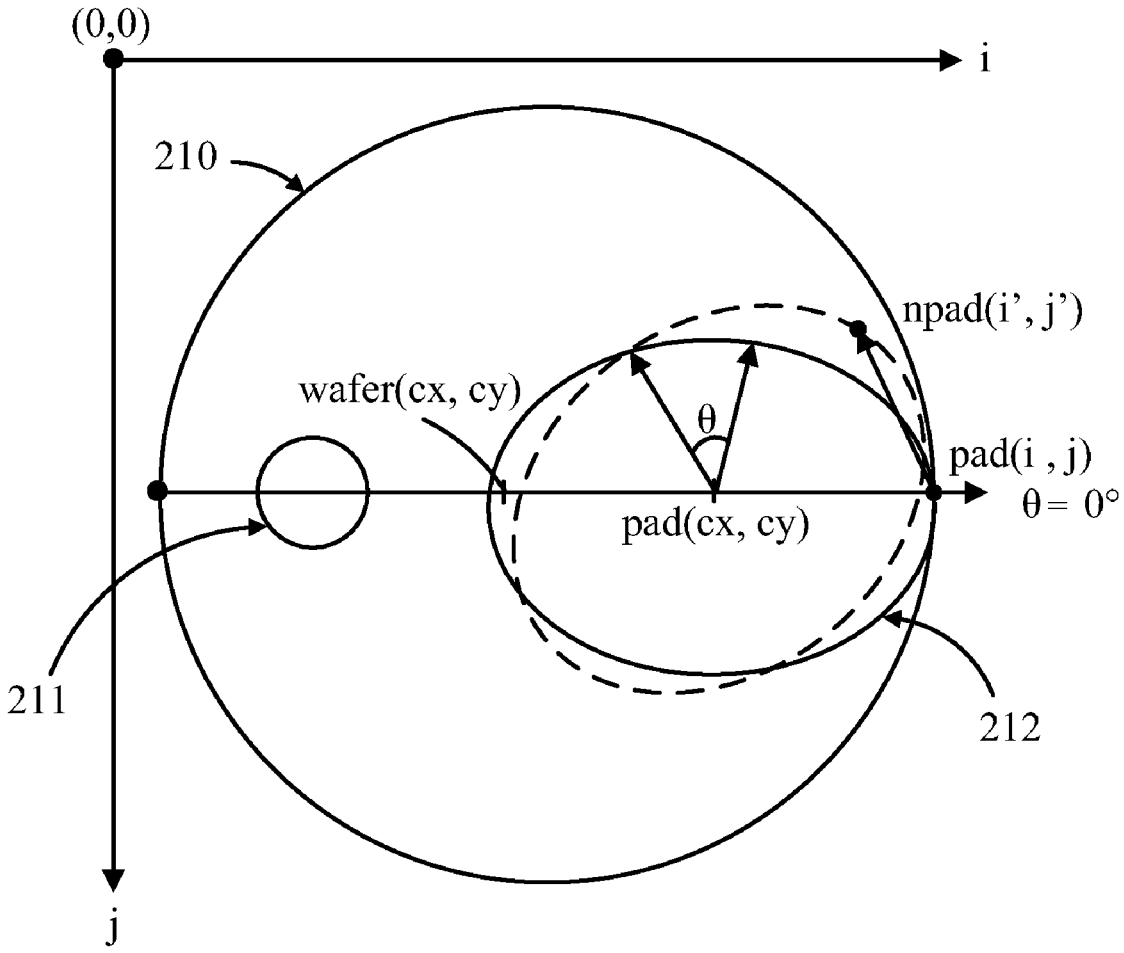
FIG. 1*c* is a schematic view of matrix position conversion of the polishing pad from point (i, j) to point (i', j') according to one embodiment of the present invention.

The patterns of the polishing pad are the cross-sectional views of the grooves on the polishing pad for removing the slurry and the polished debris on the wafer. In one embodiment, the cross-sectional views of the grooves are square-shaped patterns, trapezoid-shaped patterns, and/or various cross-section patterns. The pattern is defined as the topography of the polishing pad from the top view, where the width of the pattern is greater than the size of the abrasive particle. For example, the pattern includes concentric circle shape, spiral shape, and/or of various shapes for exhausting the slurry and the polished debris on the wafer. Preferably, the profile of the polishing pad is circular shape. In FIG. 1*a*, it shows a schematic view of a polishing system for performing the compensation CMP process according to one embodiment of the present invention. However, the profile of the polishing pad can be various shapes, such as oval-shaped, plum blossom shape, and/or triangle shape, and used in FIG. 1*a*. In FIGS. 1*a*, 1*b* and 1*c*, indication numbers 210, 211, and 212 represent wafer, polishing pad and compensation polishing head, respectively.

Figure 2:
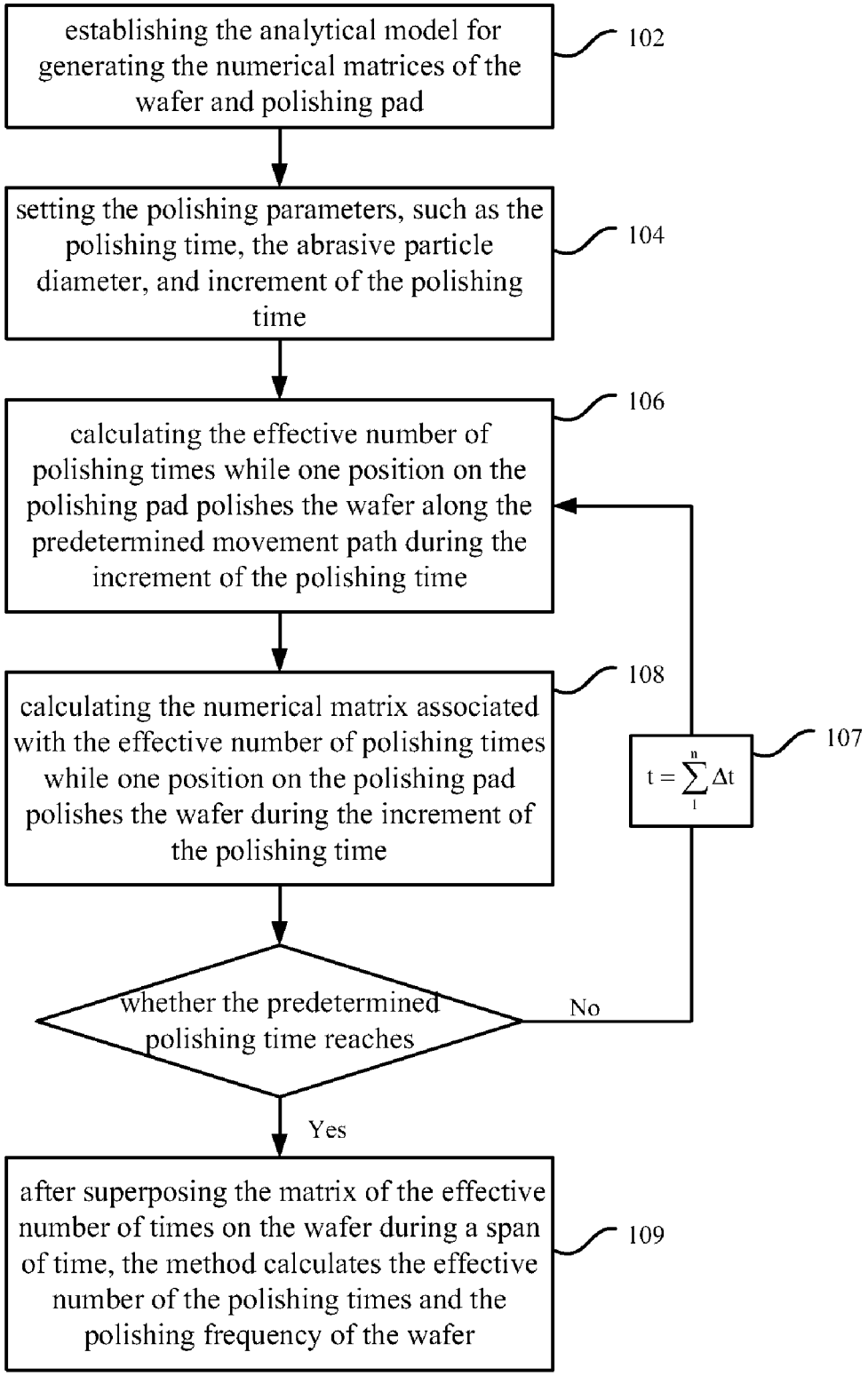
FIG. 2 is a schematic flow chart of analyzing the polishing effective frequency and the number of polishing times according to one embodiment of the present invention.

Please refer to FIG. 1*a*, FIG. 1*b*, and FIG. 2. FIG. 1*b* is a schematic analytical view of relative movement path between the wafer and the polishing pad according to one embodiment of the present invention. FIG. 2 is a schematic flow chart of analyzing the polishing effective frequency and the number of polishing times according to one embodiment of the present invention. When the compensation CMP system polishes the wafer at a relative motion and generates a planetary movement path based on different profiles of the polishing pad, FIG. 2 shows the steps of analyzing the polishing effective frequency and the number of polishing times.

In FIG. 1*b*, if the compensation CMP system polishes the wafer at a relative motion and generates a planetary movement path, the relative velocity between the wafer and the polishing pad is described by the formula: $U=\sqrt{R_p^2(\omega_w-\omega_p)^2(\cos\theta_p)^2+D_{wp}^2 w_p^2}$, where $(R_p, \theta_p)$ is the point coordinate on the wafer, $\omega_w$ and $\omega_p$ are the rotation speed of the wafer and the polishing pad, respectively, and $D_{wp}$ is the central distance between the wafer 210 and the polishing pad 211, as shown in FIG. 1*b*.

Figure 3A:
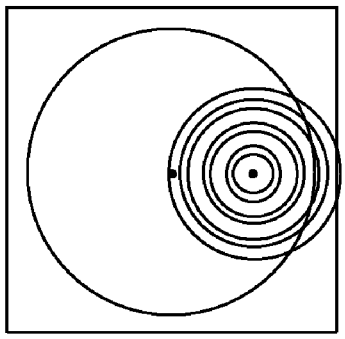
FIG. 3*a* is a schematic pixel image of the wafer and the polishing pad according to one embodiment of the present invention.

In step 102, the numerical matrices associated with the wafer and the polishing pad are analytically modeled, respectively. The image of the polishing pad is designed by computer aided design (CAD) software, such as application program "AUTOCAD". The polishing pad and wafer images are generated according to the factual sizes of the polishing pad and wafer. The profile of the image of the polishing pad can be circular-shaped, oval-shaped, and/or plum blossom shape. The pattern of polishing pad includes concentric circle shape, spiral shape, and/or one of various shapes. FIG. 3*a* is a schematic pixel image, such as size of 300 by 300 (pixel unit), of the wafer and the polishing pad according to one embodiment of the present invention. The image of the polishing pad has the profile of circular shape and the pattern of concentric circle shape. The images of the wafer and the polishing pad generated by the CAD software is then converted into the pixel matrix P*Q, where "P" and "Q" are positive integers. In one embodiment, the images are acquired by the image processing software.

Figure 3B:
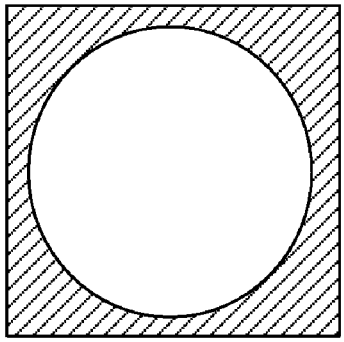
FIG. 3*b* is a schematic monochrome view of the wafer according to one embodiment of the present invention.
Figure 3C:
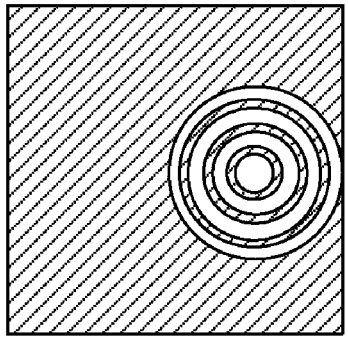
FIG. 3*c* is a schematic monochrome view of the polishing pad according to one embodiment of the present invention.
Figure 4A:
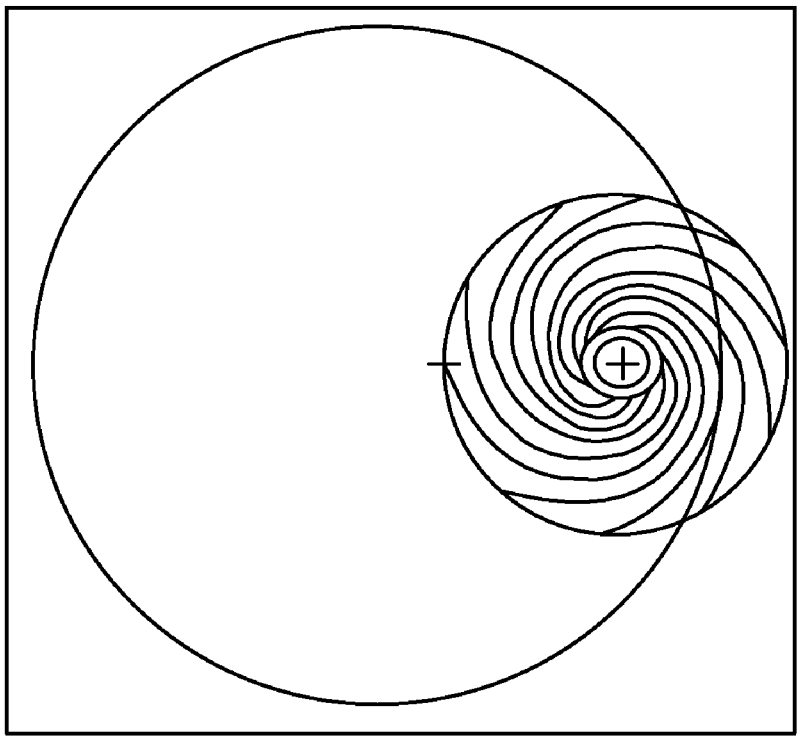
FIG. 4*a* is a schematic view of a polishing pad having spiral patterns on the polishing head of the compensation system according to one embodiment of the present invention.
Figure 4B:
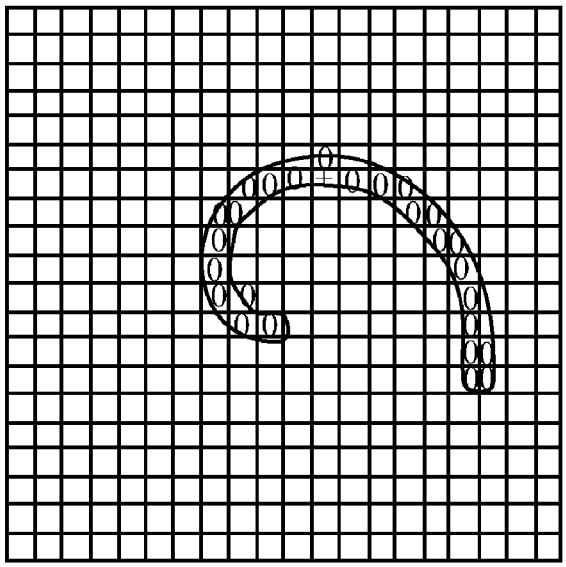
FIG. 4*b* is a schematic area enveloped by a spiral pattern wherein values "0" represent the points of the spiral pattern and values "1" represent the points except the values "0" according to one embodiment of the present invention.
Figure 5A:
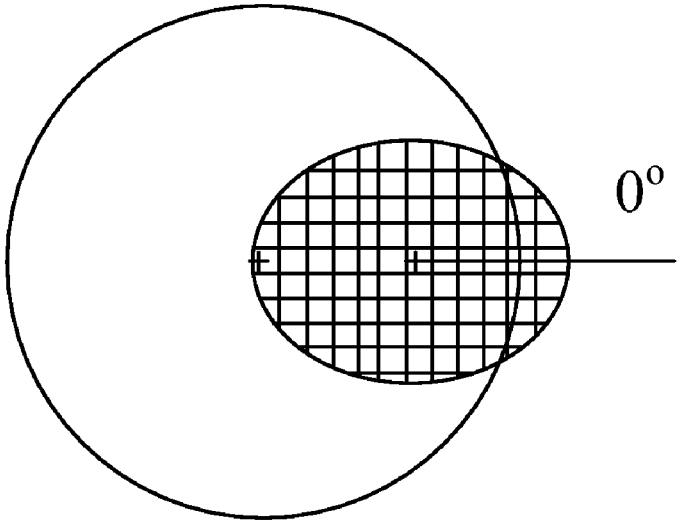
FIG. 5*a* is a schematic view of the polishing pad having an oval-shaped profile composed of a plurality of lattices according to one embodiment of the present invention.
Figure 5B:
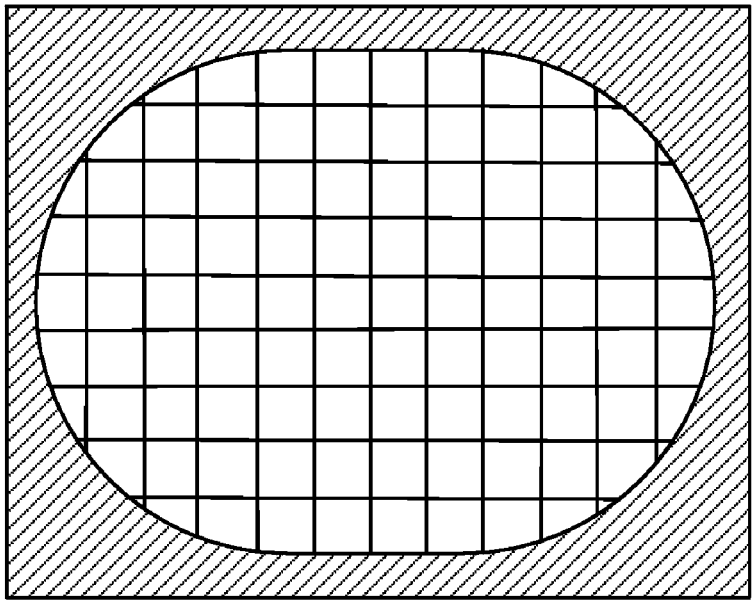
FIG. 5*b* is a schematic monochrome view of the polishing pad of the transformation of the oval-shaped profile composed of the lattices shown in FIG. 5*a* according to one embodiment of the present invention.
Figure 5C:
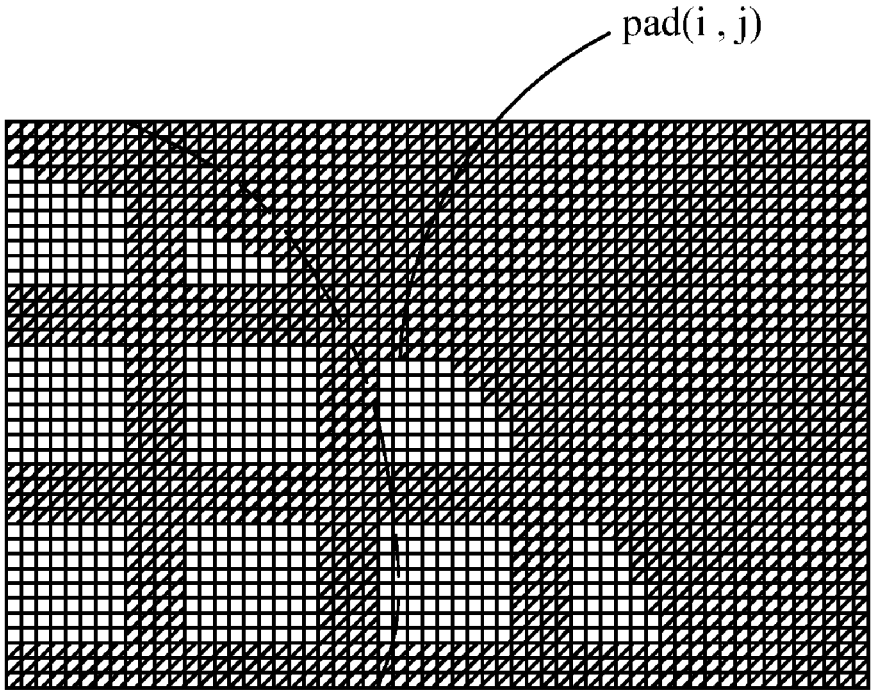
FIG. 5*c* is a partially enlarged view of the polishing pad shown in FIG. 5*b* according to one embodiment of the present invention.
Figure 5D:
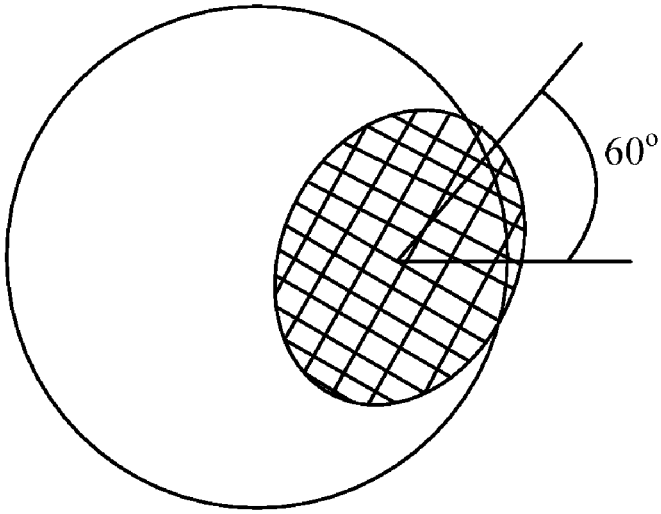
FIG. 5*d* is a schematic view of the polishing pad having an oval-shaped profile with rotation angle 60° according to one embodiment of the present invention.
Figure 5E:
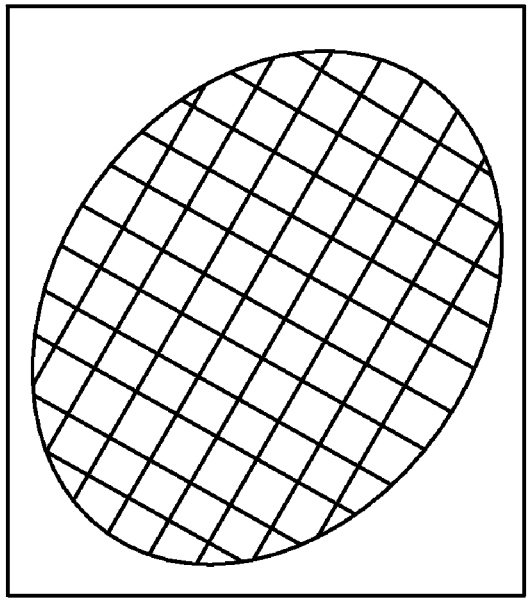
FIG. 5*e* is a schematic monochrome view of the polishing pad of the transformation of the oval-shaped profile with rotation angle 60° according to one embodiment of the present invention.
Figure 5F:
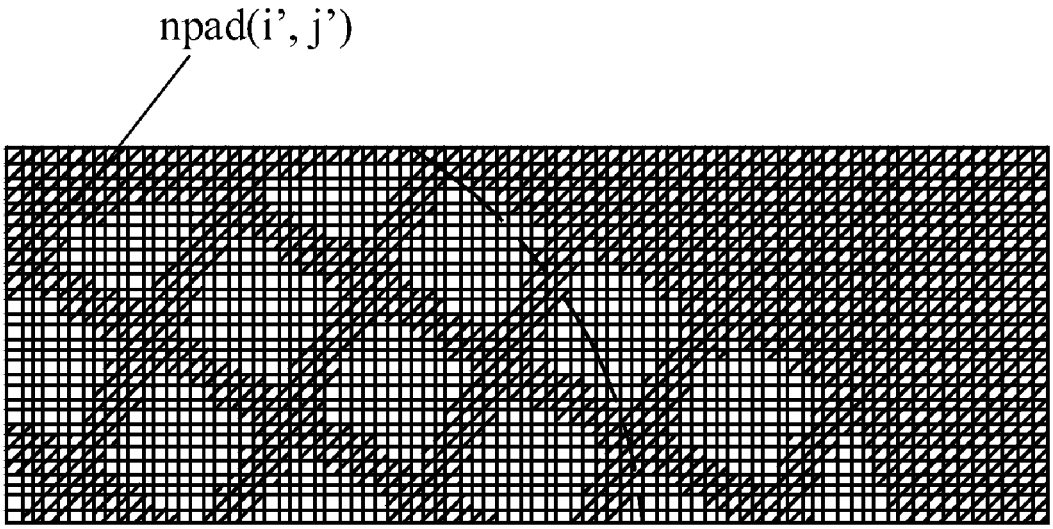
FIG. 5*f* is a partially enlarged view of the polishing pad with rotation angle 60° shown in FIG. 5*e* according to one embodiment of the present invention.
Figure 6A:
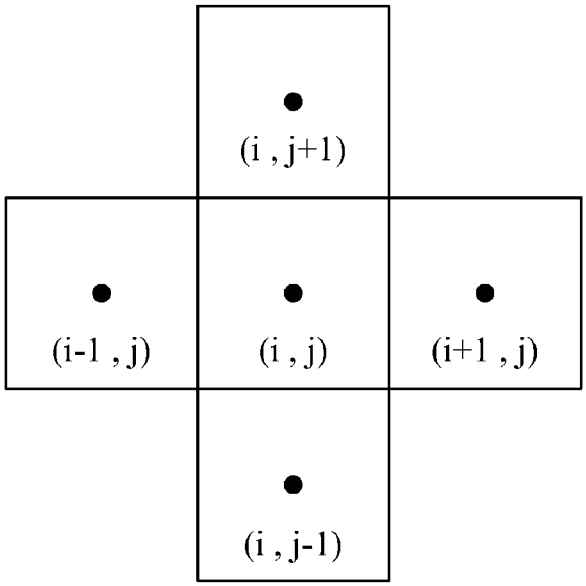
FIG. 6*a* is a schematic view of four points surrounding the arbitrary point (i, j) on the polishing pad before changing a rotation angle according to one embodiment of the present invention.
Figure 6B:
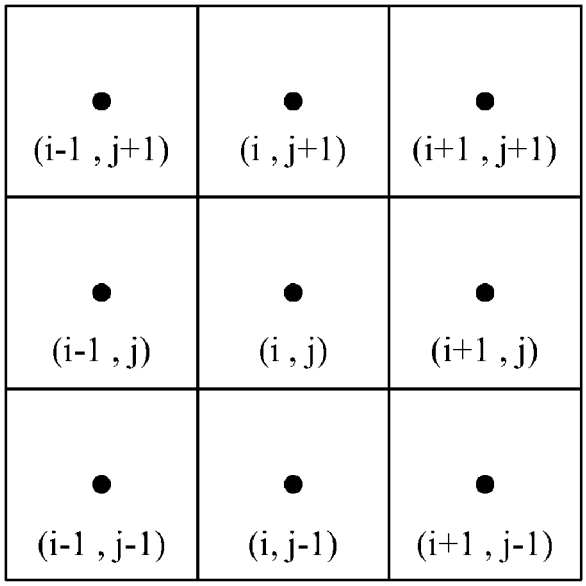
FIG. 6*b* is a schematic view of binary-conversion matrix positions of the polishing pad having different patterns and profiles at different rotation angles according to one embodiment of the present invention.
Figure 6C:
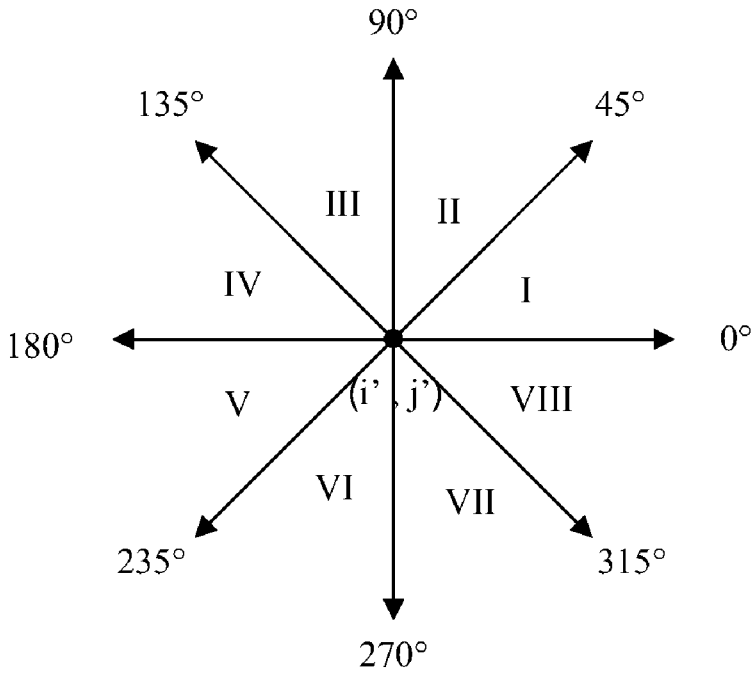
FIG. 6*c* is a schematic view of the values of four points on the polishing pad positioned at different directions, respectively, after changing a rotation angle θ according to one embodiment of the present invention.

The size ratio of the wafer to the polishing pad is kept constant and the images of the wafer and the polishing pad generated by the CAD software are re-processed into two single monochrome images, respectively. The image processing software then converts the image of the wafer and the polishing pad shown in FIG. 3*a* into monochrome formats including the wafer image, as shown in FIG. 3*b*, and the polishing pad image, as shown in FIG. 3*c*. The region of white color represents at least one of the wafer and the polishing pad and the region of black color represents no physical area.

Then, the monochrome formats are transformed into the numerical matrices. That is, according to the transformation principle of binary-conversion numerical matrices, image analytical processing software tool, such as Matlab application software, transforms the image into the numerical matrices. Meanwhile, the pixel value in the region of white color is "255" and the pixel value in the region of black color is "0". The numerical matrices are then converted into the binary-conversion numerical matrices, where the values in the region having the white color of the wafer and the polishing pad is "1" and the values in the region having the black color is "0". The binary-conversion numerical matrices of the wafer and the polishing pad are the matrices including binary numbers, i.e. "0" and "1", where "1" represents physical region and "0" represents the lack of physical region.

The matrices include physical region while the binary numbers in the binary-conversion numerical matrices associated with the wafer and the polishing pad is equal to "1". Thus, the binary number, i.e. pad (i, j), in the binary-conversion numerical matrices of the wafer is "1" and binary number, i.e. wafer (i, j), in the binary-conversion numerical matrices of the polishing pad is equal to "1" mean that the polishing pad polishes the wafer.

In step 104 of FIG. 2, the polishing parameters, e.g. polishing time, the size of the abrasive particle, and the interval increment of the polishing time, are set. The polishing frequency and the number of polishing times are inputted to analyze the polishing parameters. The method of the present invention employs some conditions, as shown in the following table. For example, the size of wafer, the diameter of polishing pad, the central distance between the wafer and the polishing pad, the diameter of abrasive particle, the interval increment of the polishing time, and total polishing time. Under different polishing conditions, the user predicts polishing frequency of the polishing pads having different patterns and profiles based on the above-mentioned parameters.

| profile of polishing pad | parameter | | | | | |
|---|---|---|---|---|---|---|
| | wafer size (mm) | diameter of polishing pad (mm) | central distance between wafer and polishing pad (mm) | abrasive particle diameter "D" (nm) | interval increment of the polishing time Δ t (sec) | total polishing time (sec) |
| Circle | 300 | 90 | 85 | 50 | 0.006 | 180 |

In step 106 of FIG. 2, the method calculates the effective number of polishing times while one position on the polishing pad polishes the wafer along the predetermined movement path during the interval increment of the polishing time Δt, as shown in FIG. 1*c*.

The method calculates the numerical matrices of the wafer (i, j) and pad (i, j), and computes the numerical matrices of the nwafer (i', j') and npad (i', j') after the wafer and the polishing pad rotates the angles ($\Delta\theta_w$, $\Delta\theta_p$) at the velocity ($\omega_w$, $\omega_p$), respectively during the interval increment of the polishing time Δt. While one position on the polishing pad polishes the wafer, the method computes the interval increment of the polishing time Δt by using the relative velocity between the wafer (i, j) and pad (i, j) for generating the effective number of polishing times of the wafer. Then, the effective number of polishing times of the wafer is recorded in the numerical matrices of the nwafer (i', j'). In addition, based on various movement paths, the method constructs different movement models.

Taking an example of planetary movement, if an absolute motion is considered and thus the wafer is deemed as fixed object, the polishing pad makes a revolution around the center axis of the wafer at rotation speed $\omega_w$ and simultaneously rotates around it own axis at rotation speed $\omega_p$. Therefore, during the interval increment of the polishing time Δt, the point on pad (i, j) has a revolution angle $\Delta\theta_w$ around the wafer and a spin angle $\Delta\theta_p$ around it own axis, where the matrix of the polishing pad is transformed from pad (i, j) to npad (i', j'). The displacement of the polishing pad can be calculated according to the following steps:

(1) FIG. 1*c* is a schematic view of matrix position conversion of the polishing pad from point (i, j) to point (i', j') according to one embodiment of the present invention. When the wafer rotates around wafer (cx, cy) and the polishing pad rotates around pad (cx, cy), and the matrix of the polishing pad from point (i, j) to point (i', j'), the binarization (two-value) numerical matrix npad (i', j') of the polishing pad is multiplied by the numerical matrix wafer (i', j') of the wafer to determine the wafer is polished effectively. Since the numerical matrices of the polishing pad and the wafer, the polishing pad polishes the wafer if pad (i, j)=1, and the method does not compute the rotation position of the polishing pad if pad (i, j)=0 to decrease the computation times.

(2) Assign the homogeneous coordinate of pad (i, j)=1 as A=(i, j, 1).

(3) If pad (i, j) makes a revolution around the center ($\omega_{cx}$, $\omega_{cy}$) of the wafer, the transposed matrix "B" is represented as the following formula:

$$B = \begin{bmatrix} 1 & 0 & 0 \\ 0 & 1 & 0 \\ -w_{cx} & -w_{cy} & 1 \end{bmatrix} \begin{bmatrix} \cos(\theta_w + \Delta\theta_w) & \sin(\theta_w + \Delta\theta_w) & 0 \\ -\sin(\theta_w + \Delta\theta_w) & \cos(\theta_w + \Delta\theta_w) & 0 \\ 0 & 0 & 1 \end{bmatrix} \begin{bmatrix} 1 & 0 & 0 \\ 0 & 1 & 0 \\ w_{cx} & w_{cy} & 1 \end{bmatrix}$$

(4) If the polishing pad rotates around its own center ($p_{cx}$, $p_{cy}$), the transposed matrix "C" is represented as the following formula:

$$C = \begin{bmatrix} 1 & 0 & 0 \\ 0 & 1 & 0 \\ -p_{cx} & -p_{cy} & 1 \end{bmatrix} \begin{bmatrix} \cos(\theta_p + \Delta\theta_p) & \sin(\theta_p + \Delta\theta_p) & 0 \\ -\sin(\theta_p + \Delta\theta_p) & \cos(\theta_p + \Delta\theta_p) & 0 \\ 0 & 0 & 1 \end{bmatrix} \begin{bmatrix} 1 & 0 & 0 \\ 0 & 1 & 0 \\ p_{cx} & p_{cy} & 1 \end{bmatrix}$$

(5) After the polishing pad has a revolution angle $\Delta\theta_w$ around the wafer and a spin angle $\Delta\theta_p$ around it own axis during the interval increment of the polishing time A t, the position of the polishing pad is changed to npad (i', j') and the matrix is represented as: npad (i', j', 1)=A×B×C. In one embodiment, "A×B×C" is round-off to generate npad (i', j'), and is modified by a cross-section check method due to the rotation error of the profile.

(6) After the method calculates the numerical matrix of pad (i, j) during the interval increment of the polishing time Δt, the unit of the coordinates on the image have changed from length unit to pixel unit and thus the unit of the polishing frequency F (i, j) need to be changed from pixel unit back to physical unit (named as scale factor, SF). Thus, the polishing frequency F (i, j) is multiplied by the scale factor (SF) during the interval increment of the polishing time Δt and represented as following formula:

$$F(i,j) = \frac{U}{d} \times SF$$

where F=the relative velocity between wafer and polishing pad ($U=\sqrt{R_p^2(\omega_w-\omega_p)^2\cos\theta_p^2+D_{\omega p}^2 w_p^2}$)/initial abrasive particle diameter (d).

Thus, the effective number of polishing times is represented as the following formula:

$$FF(i',j')=F(i,j)\times \mathrm{SLEF}(i',j')\times \Delta t$$

where SLEF (i', j') is effective polishing factor ratio along the linear path.

In step 108 of FIG. 2, the method calculates the numerical matrix associated with the effective number of polishing times while one position on the polishing pad polishes the wafer during the interval increment of the polishing time Δt.

In step 109 of FIG. 2, the method determines whether the predetermined polishing time reaches. If no, return step 107 to accumulate time and back to step 106. If yes, return step 110.

During the interval increment of the polishing time Δt, the method calculate the numerical matrix, $[FF(i',j')]_{P\times Q}$, associated with the effectiveness of polishing frequency on the wafer. The method employs the step 106 to calculate the value of effective number of times, FF (i', j'), on the wafer, which is preferably described by the following programs:

```
for i =1 to P
  for j =1 to Q
```

-continued

```
        FF(i',j') = F(i,j)×SLEF(i',j')×Δt
        next j
    next i
```

In step 110 of FIG. 2, after superposing the matrix of the effective number of times on the wafer during a span of time, the method calculates the polishing frequency.

The method calculates the matrix, $[\text{sum } FT_{k\ ij}]_{P\times Q}$, of the effective number of polishing times. After superposing the matrices of the calculated effective number of times during each of incremental time duration, the distribution statuses of the number of polishing times is generated during the total polishing time (t). The total polishing time (t) is equal to the sum of the increments of the polishing time Δt. The matrices, $[FF\ (i', j')]_{P\times Q}$ corresponding to each initial positions are superposed to generate the effective number of polishing times in the point (i, j) during the total polishing time (t). Then, the effective number of polishing times in the points (i, j) are represented as the matrix, [P×Q], to generate the matrix, $[\text{sum } FT_{k\ ij}]_{P\times Q}$, of the total effective number of polishing times. The matrix is represented as the following formula:

$$[sumFT_{kij}]_{P\times Q} = \sum_{k=1}^{n} [FF]_{P\times Q},\ n = t/\Delta t$$

The method calculates the matrix, $[\text{avg } FT_{k\ ij}]_{P\times Q}$, of the effectiveness of polishing frequency by dividing the matrix, $[\text{sum } FT_{k\ ij}]_{P\times Q}$, of the total effective number of polishing times by the total polishing time (t), as shown by following formula:

$$[avgFT_{kij}]_{P\times Q} = [sumFT_{kij}]_{P\times Q} \times \frac{60}{t}$$

When the generic CMP system is utilized, the wafer (shown in a small circle) is positioned above the polishing pad (shown in a big circle), however, the method of analyzing steps is the same as the above-mentioned steps.

Figure 7A:
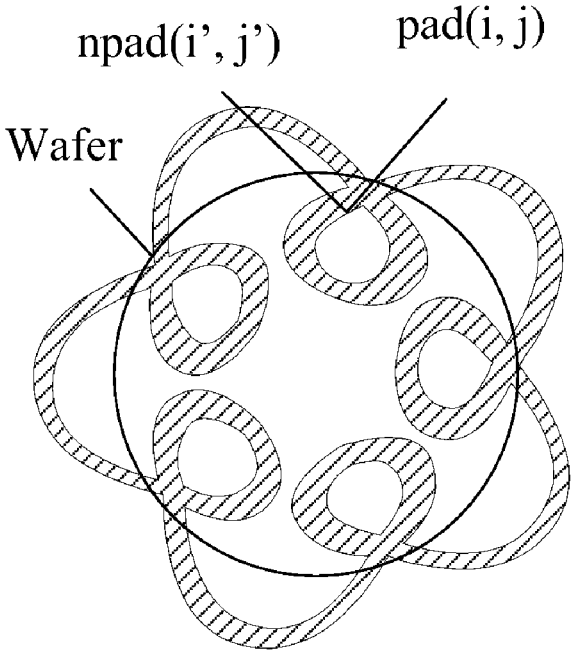
FIGS. 7*a*-7*c* are schematic views of the polishing pad according to another embodiment of the present invention.
Figure 7B:
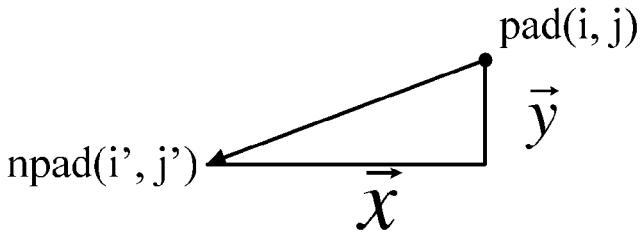
Figure 7B:
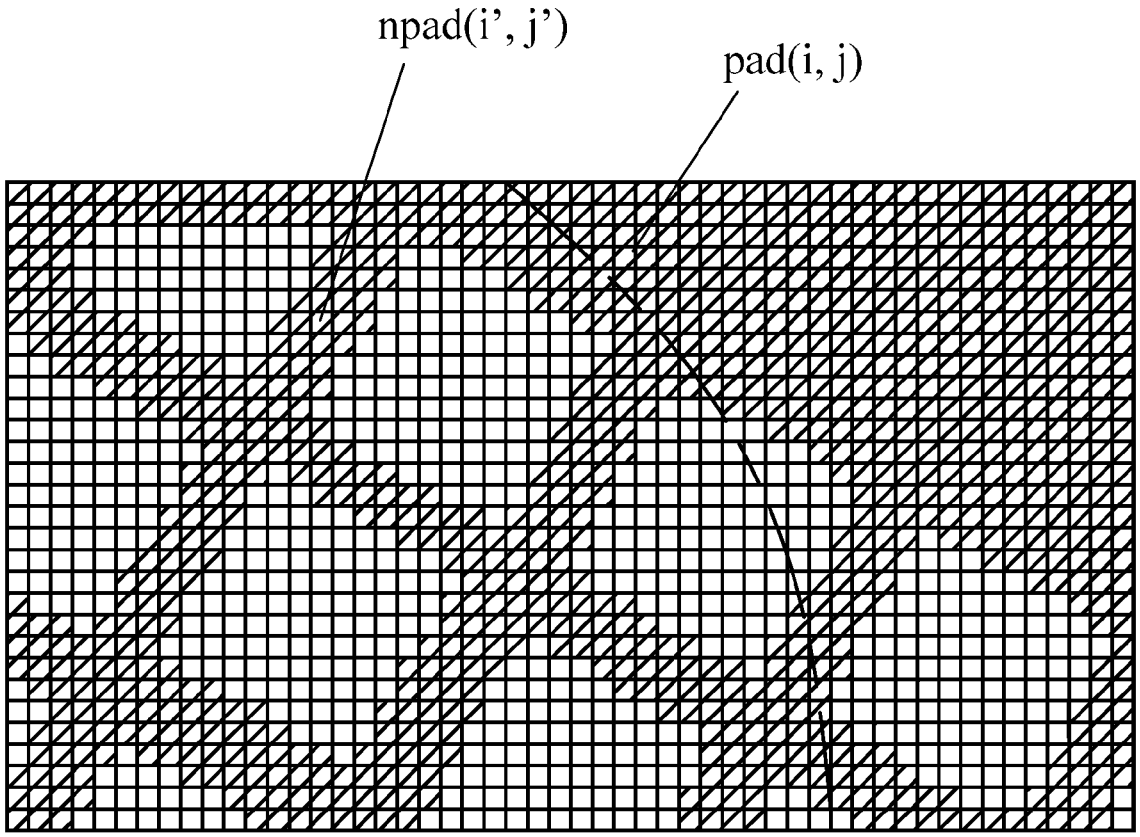
Figure 7C:
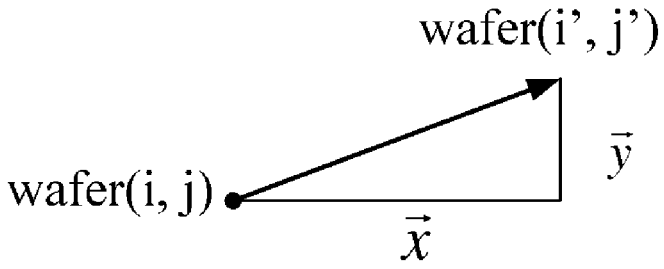
Figure 7C:
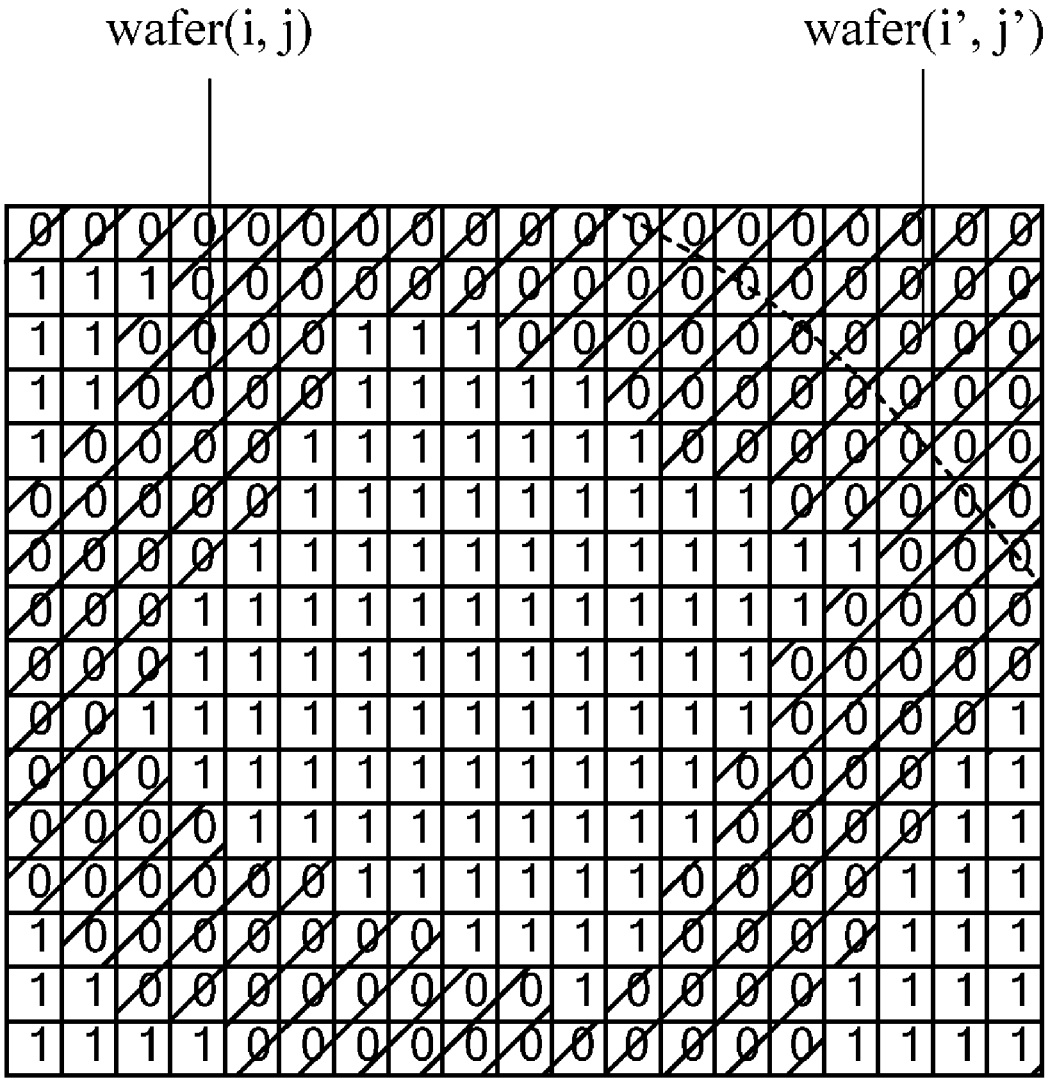

FIGS. 7*a*-7*c* are schematic views of the polishing pad according to another preferred embodiments of the present invention.

Figure 8:
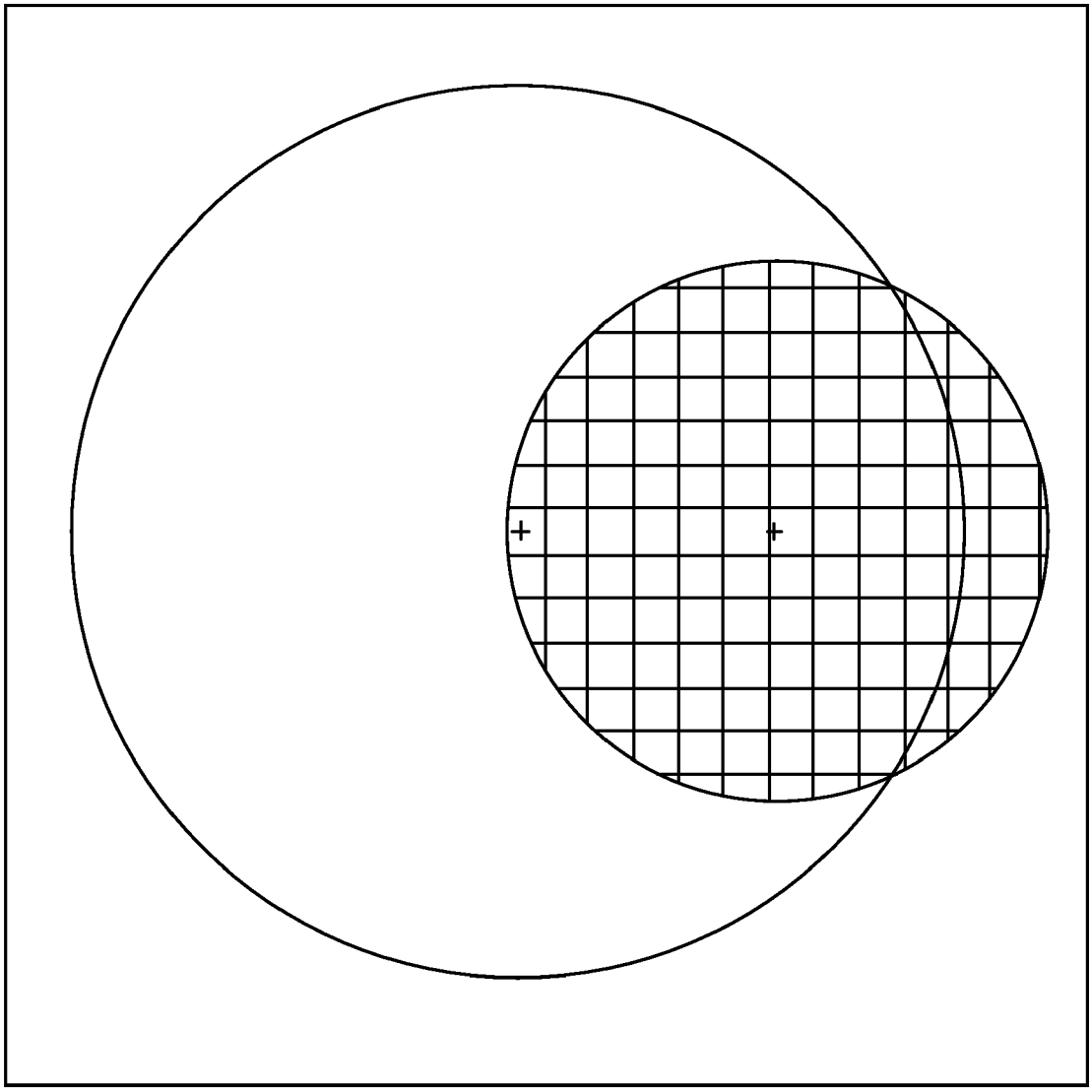
FIG. 8 is a schematic view of the polishing pad having a circular-shaped profile composed of a plurality of lattices according to one embodiment of the present invention.

FIG. 8 is a schematic view of the polishing pad having a circular-shaped profile composed of a plurality of lattices according to one embodiment of the present invention.

Figure 9:
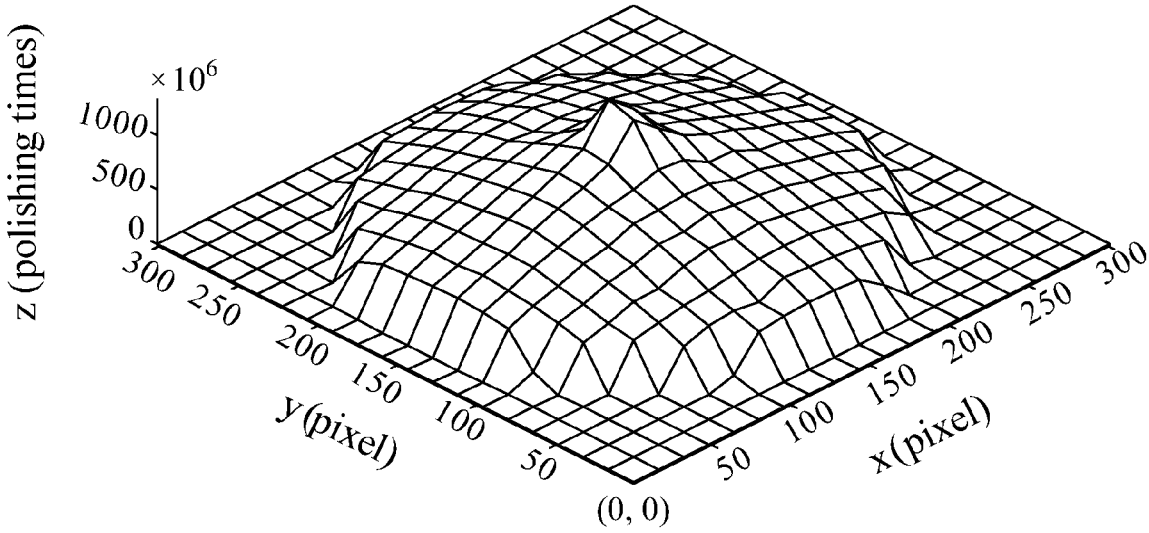
FIG. 9 is a three-dimensional meshed view for determining the number of polishing times of the polishing pad having a circular-shaped profile according to one embodiment of the present invention.

FIG. 9 is a three-dimensional meshed view for determining the number of polishing times of the polishing pad having a circular-shaped profile according to one embodiment of the present invention.

The advantages of the present invention includes: (1) the method converts the images of the wafer and the polishing pad into binary image format and calculates the effective number of polishing times at a superposition manner during the total polishing time (t); (2) the method calculates the polishing times by computing the number matrices when the positions of the wafer and the polishing pad are changed and patterns and profiles at a relative motion are modified; (3) the distribution statuses of the number of polishing times is generated during the total polishing time (t) after superposing the matrix of the effective number of times.

The present invention provides an analytic method for the parameters, including effective polishing frequency and polishing times on the wafer, of the planarization process in the CMP process. The method is suitable for the effectiveness of polishing frequency and the number of polishing times in the compensation CMP process and generic MP process to evaluate the distribution statuses of the effectiveness of polishing frequency and the number of polishing times when the wafer and the polishing pad have different patterns and profiles.

The present invention utilizes the CAD software and the image processing method for digitalizing the design model of the wafer and the polishing pad. Further, the number matrix of polishing pad has a relative motion to the number matrix of the wafer. Preferably, image generated by the CAD software, such as AUTOCAD application program, easily forms the image with correct proportion. The method evaluates the distribution statuses of the effectiveness of polishing frequency and the number of polishing times by superposition when the wafer and the polishing pad have different patterns and profiles. In addition, the region composed of binary pixels represents that the polishing pad exerts polished force on the wafer and can be increased or decreased to be suitable for a desired precision.

The polishing pad of the present invention has different patterns and the profiles. The profiles can be circular shape and oval-shaped and the patterns of the polishing pad can be square lattice and concentric circle shapes. The method of the present invention designs the polishing pad on the basis of the factors including various patterns, profiles, and polishing movement path. During a span of time, the method evaluates the distribution statuses of the effectiveness of polishing frequency and the number of polishing times to be referred by the endpoint detection and the planarization process.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A method of analyzing the effectiveness of polishing frequency and the number of polishing times of the polishing pad having different patterns and profile, the method comprising the steps of:

providing an image of polishing pad and a wafer image;

converting the image of polishing pad and the wafer image into a plurality of pixel matrices, respectively;

processing the pixel matrices into a plurality of monochrome images, respectively;

converting the monochrome images into a plurality of numerical matrices, respectively;

transforming the numerical matrices into a plurality of binary numerical matrices including values "0" and "1";

constructing the numerical matrices of the wafer and the polishing pad;

calculating the effective number of polishing times while one position on the polishing pad polishes the wafer along a predetermined movement path during the interval increment of the polishing time;

calculating the numerical matrix associated with the effective number of polishing times while one position on the polishing pad polishes the wafer during the interval increment of the polishing time;

correcting a deformation error and a cumulative error of the number of polishing times due to the different pattern and profile of the polishing pad; and calculating the effective number of the polishing times and the polishing frequency of the wafer after superposing the matrix of the effective number of times on the wafer during a span of time.

2. The method of claim 1, wherein the image of polishing pad and the wafer image are designed by CAD software.

3. The method of claim 1, wherein the profile of the image of polishing pad is selected from one group consisting of a circular shape, an oval shape, a plum blossom shape and the combinations thereof, and the pattern of the wafer image is selected from one group consisting of a concentric circle shape, a square lattice, a spiral shape and the combinations thereof.

4. The method of claim 1, wherein an image processing software is utilized in the steps of converting the image of polishing pad and the wafer image into the pixel matrices, respectively and processing the pixel matrices into the monochrome images, respectively.

5. The method of claim 1, wherein a region of black color in the monochrome images represents the area having no physical material and a region of white color represents the area having physical material.

6. The method of claim 1, wherein an image analytical processing software tool is utilized in the step of converting the monochrome images into a plurality of numerical matrices, respectively.

7. The method of claim 1, wherein the value "1" represents the area having physical material and the value "0" represents the area having no physical material in the binary numerical matrices.

8. The method of claim 1, further comprising a step of re-defining a coordinate system, comprising the steps of:

defining a central coordinate of the wafer as a coordinate origin; and translating the wafer and the polishing pad for unifying the coordinates of the binary numerical matrices to a new coordinate system.

9. The method of claim 1, wherein the predetermined movement path is a planetary movement path.

10. The method of claim 9, wherein the planetary movement path is an absolute motion, the wafer is deemed as a fixed object, and the displacement of the fixed object can be calculated according to the following steps:

(1) the polishing pad is moved from point (i, j) to point (i', j') according to one embodiment of the present invention. When the wafer rotates around wafer (cx, cy) and the polishing pad rotates around pad (cx, cy), and the matrix of the polishing pad from point (i, j) to point (i', j'), the binarization (two-value) numerical matrix npad (i', j') of the polishing pad is multiplied by the numerical matrix wafer (i', j') of the wafer to determine the wafer is polished effectively;

(2) since the numerical matrices of the polishing pad and the wafer, the polishing pad polishes the wafer if pad (i, j)=1, and the method does not compute the rotation position of the polishing pad if pad (i, j)=0 to decrease the computation times;

(3) assign the homogeneous coordinate of pad (i, j)=1 as A=(i, j, 1);

(4) if pad (i, j) makes a revolution around the center ($\omega_{cx}$, $\omega_{cy}$) of the wafer, the transposed matrix "B" is represented as the following formula:

$$B=\begin{bmatrix}1&0&0\\0&1&0\\-w_{cx}&-w_{cy}&1\end{bmatrix}\begin{bmatrix}\cos(\theta_w+\Delta\theta_w)&\sin(\theta_w+\Delta\theta_w)&0\\-\sin(\theta_w+\Delta\theta_w)&\cos(\theta_w+\Delta\theta_w)&0\\0&0&1\end{bmatrix}\begin{bmatrix}1&0&0\\0&1&0\\w_{cx}&w_{cy}&1\end{bmatrix}$$

(5) If the polishing pad rotates around its own center ($p_{cx}$, $p_{cy}$), the transposed matrix "C" is represented as the following formula:

$$C=\begin{bmatrix}1&0&0\\0&1&0\\-p_{cx}&-p_{cy}&1\end{bmatrix}\begin{bmatrix}\cos(\theta_p+\Delta\theta_p)&\sin(\theta_p+\Delta\theta_p)&0\\-\sin(\theta_p+\Delta\theta_p)&\cos(\theta_p+\Delta\theta_p)&0\\0&0&1\end{bmatrix}\begin{bmatrix}1&0&0\\0&1&0\\p_{cx}&p_{cy}&1\end{bmatrix}$$

(6) After the polishing pad has a revolution angle $\Delta\theta_w$ around the wafer and a spin angle $\Delta\theta_p$ around it own axis during the interval increment of the polishing time $\Delta t$, the position of the polishing pad is changed to npad (i', j') and the matrix is represented as: npad (i', j', 1)=A×B×C. In one embodiment, "A×B×C" is round-off to generate npad (i', j'), and is modified by a cross-section check method due to the rotation error of the profile;

(7) After the method calculates the numerical matrix of pad (i, j) during the interval increment of the polishing time $\Delta t$, the unit of the coordinates on the image have changed from length unit to pixel unit and thus the unit of the polishing frequency F (i, j) need to be changed from pixel unit back to physical unit (named as scale factor, SF), thus, the polishing frequency F (i, j) is multiplied by the scale factor (SF) during the increment of the polishing time $\Delta t$ and represented as following formula:

$$F(i,j)=\frac{U}{d}\times SF$$

where F=the relative velocity between wafer and polishing pad ($U=\sqrt{R_p^2(\omega_w-\omega_p)^2\cos\theta_p^2+D_{\omega p}^2 w_p^2}$)/initial abrasive particle diameter (d), thus, the effective number of polishing times is represented as the following formula:

$$FF(i',j')=F(i,j)\times \mathrm{SLEF}(i',j')\times\Delta t$$

where SLEF (i', j') is effective polishing factor ratio along the linear path.

11. The method of claim 1, wherein the effectiveness of polishing frequency is defined that the contact times per time unit between a position on the wafer and the abrasive particle on the polishing pad; during a time interval, the number of polishing times is defined as the grinding times when the abrasive particle contact the wafer and the abrasive particle then polishes the wafer, that is, the number of polishing times represents the total amount of abrasive particles passing through the same position on the wafer during the time interval.

12. The method of claim 1, during the step of correcting a deformation error and a cumulative error of the number of polishing times due to the different pattern and profile of the polishing pad, further comprising the steps of:

acquiring the size of the least pixel number (LPN), which is determined by the following rule: the image having the length and width sizes of "L×L" is divided into the pixel matrix "N×N" (pixels);

transforming the image generated by the CAD software into the binary numerical matrix wherein the proportion of the length and the width of the image is kept constant after the transformation;

acquiring each pixel matrix having different size wherein each pixel unit represents the area having relative ratio, and the number of polishing times is multiplied by the scale factor (SF);

converting the length size of the pixel into the factual length size;

generating a polishing path wherein since a portion of the rotation polishing path located out of the wafer is ineffective polishing and another portion of rotation polishing path located on the wafer is effective polishing, it is required to compute the movement increment points of the polishing pad and calculates the total amount of the value "1" in the polished wafer numerical matrix along the straight line-path, and the straight line-path effective polishing factor (SLEF) can be represented by SLEF; and correcting the errors in the polishing pad having different patterns and profiles by a cross-section check (CSC) method, wherein the cross-section check (CSC) method corrects the four points around the rotation position to the relative positions, respectively.

13. The method of claim 12, wherein the least pixel number (LPN) comprises that the least pattern area need to be satisfied with the following formula: $A \geqq (L/N)^2$, and the least pixel number (LPN) need to be satisfied with the following formula: $LPN \geqq L\sqrt{A}$.

14. The method of claim 12, wherein during the steps of:

acquiring each pixel matrix having different size wherein each pixel unit represents the area having relative ratio, and the number of polishing times is multiplied by the scale factor (SF);

converting the length size of the pixel into the factual length size;

wherein the scale factor (SF) can be represented by the following formula:

SF=(diameter($d_w$) of the wafer profile of the design image)/(pixel number on the wafer based on the diameter($d_w$) after converting wafer profile into image).

15. The method of claim 12, wherein the unit angle $\Delta\theta$ in the straight line-path effective polishing factor (SLEF) is small, the rotation path of the polishing pad from pad (i, j) to npad (i', j') is a straight line-path approximately, assume that $\vec{x}=i'-i$, $\vec{y}=j'-j$, the linear length (l) from pad (i, j) to npad (i', j') is $l=\sqrt{\vec{x}^2+\vec{y}^2}$;

when the position of the numerical matrix moves from pad (i, j) to npad (i', j'), the movement increment point of the polishing pad is represented as the following formula:

$$\text{pad}\left(i+\text{fix}\left(nstep*\frac{\bar{x}}{\sqrt{\bar{x}^2+\bar{y}^2}}\right),\ j+\text{fix}\left(nstep*\frac{\bar{y}}{\sqrt{\bar{x}^2+\bar{y}^2}}\right)\right);$$

the coordinates of the pad (i, j) has to be located in the integer of the binary numerical matrix, the "fix" symbol represents that the method takes the integer by round-off after increasing the unit length increment, the "nstep" symbol represents length interval and is range from 1 to l wherein the unit interval is one, the straight line-path effective polishing factor (SLEF) can be represented by the following formula:

SLEF=(total amount of the position value "1" on the polished wafer numerical matrix along the straight line-path)/(total amount of the positions on the polished wafer numerical matrix along the straight line-path).

16. The method of claim 12, wherein the cross-section check (CSC) represents that before the polishing pad rotates, the four points around the pad (i, j) are pad (i+1, j), pad (i−1, j), pad (i, j+1), and pad (i, j−1), and because it is required that the values of the four points are the same before and after the rotation of the polishing pad, the correction position is defined as the cross position surrounded by the four points;

after pad (i, j) on the polishing pad makes revolution and rotation, pad (i, j) moves to npad (i', j'), the rotation angle of the profile of the polishing pad is represented by the formula: $\theta=(\theta_p+\Delta\theta_p)+(\theta_w+\Delta\theta_w)$, and after the polishing pad rotates, the center npad (cx', cy') of the polishing pad can be moved to pad (cx, cy) to calculate the included angle $\theta$;

if the rotation interval is represented by the formula: $0°<\theta<45°$, the effective number of polishing times at the four points surrounding npad (i', j') is FF(i', j'), and the values of the effective number of polishing times at the four points are recorded on the relative positions of the wafer, that is, wafer (i+1, j)=FF(i+1', j'), wafer (i, j+1)=FF(i', j+1'), wafer (i−1, j)=FF(i−1', j'), and wafer (i, j−1)=FF(i', j−1');

if the rotation interval is represented by the formula: $45°<\theta\leqq 90°$, then, wafer($i$+1,$j$)=$FF$($i$+1',$i$+$j$'), wafer($i$,$j$+1)=$FF$($i$−1',$j$'), wafer ($i$−1,$j$)=$FF$($i$−1', $j$−1'), and wafer($i$,$j$−1)=$FF$ ($i$+1',$j$−1'); and correcting the binary numerical matrix after the polishing pad having different patterns and profile rotates at a different angle.

17. The method of claim 1, wherein after superposing the matrix of the effective number of times on the wafer during a span of time, the polishing frequency and the number of polishing times are calculated, the matrix, $[\text{sum } FT_{k\,ij}]_{P\times Q}$, of the effective number of polishing times is calculated, and after superposing the matrices of the calculated effective number of times during each of incremental time duration, the distribution statuses of the number of polishing times is generated during the total polishing time (t); and wherein the total polishing time (t) is equal to the sum of the increments of the polishing time $\Delta t$, the matrices, $[FF(i', j')]_{P\times Q}$ corresponding to each initial positions are superposed to generate the effective number of polishing times in the point (i, j) during the total polishing time (t).

18. The method of claim 17, wherein during the interval increment of the polishing time $\Delta t$, the numerical matrix, $[FF(i', j')]_{P\times Q}$, associated with the effectiveness of polishing frequency on the wafer is calculated, and the value of effective number of times, FF (i', j'), on the wafer is calculated, which is preferably described by the following programs:

```
for i =1 to P
  for j =1 to Q
    FF(i',j') = F(i,j)×SLEF(i',j')×Δt
  next j
next i.
```

19. The method of claim 17, wherein the polishing frequency and the number of polishing times are calculated, the matrix, $[\text{sum } FT_{k\,ij}]_{P\times Q}$, of the effective number of polishing times is calculated, and after superposing the matrices of the calculated effective number of times during each of incremental time duration, the distribution statuses of the number of polishing times is generated during the total polishing time (t); and wherein the total polishing time (t) is equal to the sum of the increments of the polishing time Δt, the matrices, $[FF(i', j')]_{P\times Q}$ corresponding to each initial positions are superposed to generate the effective number of polishing times in the point (i, j) during the total polishing time (t).

* * * * *